United States Patent [19]

Shao

[11] Patent Number: 5,076,769

[45] Date of Patent: Dec. 31, 1991

[54] DOUBLE ACTING PUMP

[75] Inventor: Jian-Dong Shao, Midland, Mich.

[73] Assignee: The Dow Chemical Company, Midland, Mich.

[21] Appl. No.: 552,725

[22] Filed: Jul. 16, 1990

[51] Int. Cl.[5] ..... F04B 21/02

[52] U.S. Cl. ..... 417/534; 417/535; 417/536; 74/55

[58] Field of Search ..... 417/534–537; 74/55, 569

[56] References Cited

U.S. PATENT DOCUMENTS

| | | | |
|---|---|---|---|
| 679,454 | 7/1901 | Connor . | |
| 1,880,494 | 10/1932 | Sandage . | |
| 3,207,083 | 9/1965 | Lohry et al. . | |
| 3,990,816 | 11/1976 | Kohler et al. | 417/536 |
| 4,028,017 | 6/1977 | Audsley | 417/534 |
| 4,236,880 | 12/1980 | Archibald | 417/479 |
| 4,494,447 | 1/1985 | Sisk | 417/534 |
| 4,603,593 | 8/1986 | Clegg | 74/55 |

FOREIGN PATENT DOCUMENTS

| | | | |
|---|---|---|---|
| 732744 | 3/1932 | France | 74/55 |
| 2064049 | 6/1981 | United Kingdom | 74/55 |

OTHER PUBLICATIONS

E. Oberg and F. D. Jones, *Machinery's Handbook*, 19, 712–719, (1974).

*Primary Examiner*—Richard A. Bertsch
*Assistant Examiner*—Michael I. Kocharov
*Attorney, Agent, or Firm*—Timothy S. Stevens

[57] ABSTRACT

An improved double acting piston pump of the type having a shaft connected to the piston for reciprocating the piston wherein the shaft extends from the pump body. The improvement of the present invention is to reciprocate the shaft with an asymmetrical uniform motion rotary cam so that the pump delivers the same constant flow rate of a liquid being pumped during both the forward and the backward movements of the pump's piston.

3 Claims, 2 Drawing Sheets

DOUBLE ACTING PUMP

BACKGROUND OF THE INVENTION

Double acting reciprocating piston pumps are an efficient means for flowing liquids because the pump both delivers and aspirates the liquid to be pumped with each stroke of the piston. Many United States Patents have been issued for improvements to double acting pumps. For example: U.S. Pat. No. 679,454 issued to Conner on July 30, 1901 disclosed air chambers to dampen pressure pulses of a manually operated double acting pump; and U.S. Pat. No. 1,880,494 issued to Sandage on Oct. 4, 1932 disclosed a double acting pump, wherein the piston was directly reciprocated by an eccentric cam.

Most piston pumps such as the pump of the Sandage patent, deliver the liquid to be pumped at a varying rate during each stroke of the piston. This varying rate results in pressure pulsations in the liquid being pumped. Some pumping applications are best made with a substantially pulseless pump, e.g., the eluent pump of a liquid chromatography chemical analysis system. Piston pumps have been developed that are substantially pulseless, e.g., the two piston cam driven pump disclosed in U.S. Pat. No. 4,028,018 issued on June 7, 1977 to Audsley.

Rotary cams are generally classified as uniform motion cams and uniformly accelerated motion cams. E. Oberg & F. Jones, *Machinery's Handbook*, 712 (1974). The uniform motion cam rotated at constant angular velocity moves the cam follower at substantially the same velocity from the beginning to the end of each stroke of the cam follower. Uniform motion cams are usually heart shaped. Uniform motion cams impart relatively sudden changes of direction to the cam follower at the beginning and the end of each stroke of the follower. This characteristic is substantially eliminated by the use of a uniformly accelerated motion cam of which an eccentric cam is an example. The cam 13 of FIG. 2 of the Audsley patent is an example of an asymmetrical hybrid four zone cam having two zones of uniformly accelerated motion and two zones of constant motion (see column 2, lines 63–68 of the Audsley patent).

It would be an advance in the art of double acting pumps if such a pump could be developed that was substantially pulseless and that delivered the liquid to be pumped at substantially the same flow rate during each entire stroke of the pump's piston.

SUMMARY OF THE INVENTION

The present invention is an advance in the art of double acting pumps because it is substantially pulseless and because the liquid to be pumped is delivered at substantially the same flow rate during each stroke of the pump's piston.

The present invention is an advance in the art of double acting pumps of the type that generally include a pump body, a piston bore, a piston, a first set of check valves, a second set of check valves, a shaft and a means for reciprocating the shaft, the piston having a cross sectional area, the body defining the piston bore, the piston bore having a first end portion and a second end portion, the piston positioned in the piston bore between the first end portion of the piston bore and the second end portion of the piston bore, the shaft connected to the piston so that the piston can be reciprocated to stroke in a first direction toward the first end portion of the piston bore and then to stroke in the opposite direction toward the second end portion of the piston bore, the shaft extending through an aperture in the pump body, the aperture in the pump body being located adjacent the second end portion of the piston bore, the shaft having a cross sectional area where the shaft extends through the aperture in the pump body, the first set of check valves being in liquid communication with the first end portion of the piston bore, the second set of check valves being in liquid communication with the second end portion of the piston bore so that on each stroke of the piston the pump both aspirates and delivers a liquid to be pumped. The improvement of the present invention is that the means for reciprocating the shaft comprises an asymmetrical uniform motion rotary cam having at least one first phase of angular rotation during which the piston is driven toward the first end portion of the piston bore and an equal number of second phases of angular rotation during which the piston is driven toward the second end portion of the piston bore, each first phase of angular rotation of the cam being greater in degrees of rotation than each corresponding second phase of angular rotation of the cam so that the pump delivers substantially the same substantially constant flow rate of a liquid being pumped during both the first phase of angular rotation of the cam and the second phase of angular rotation of the cam.

DETAILED DESCRIPTION OF THE INVENTION

Figure 1:
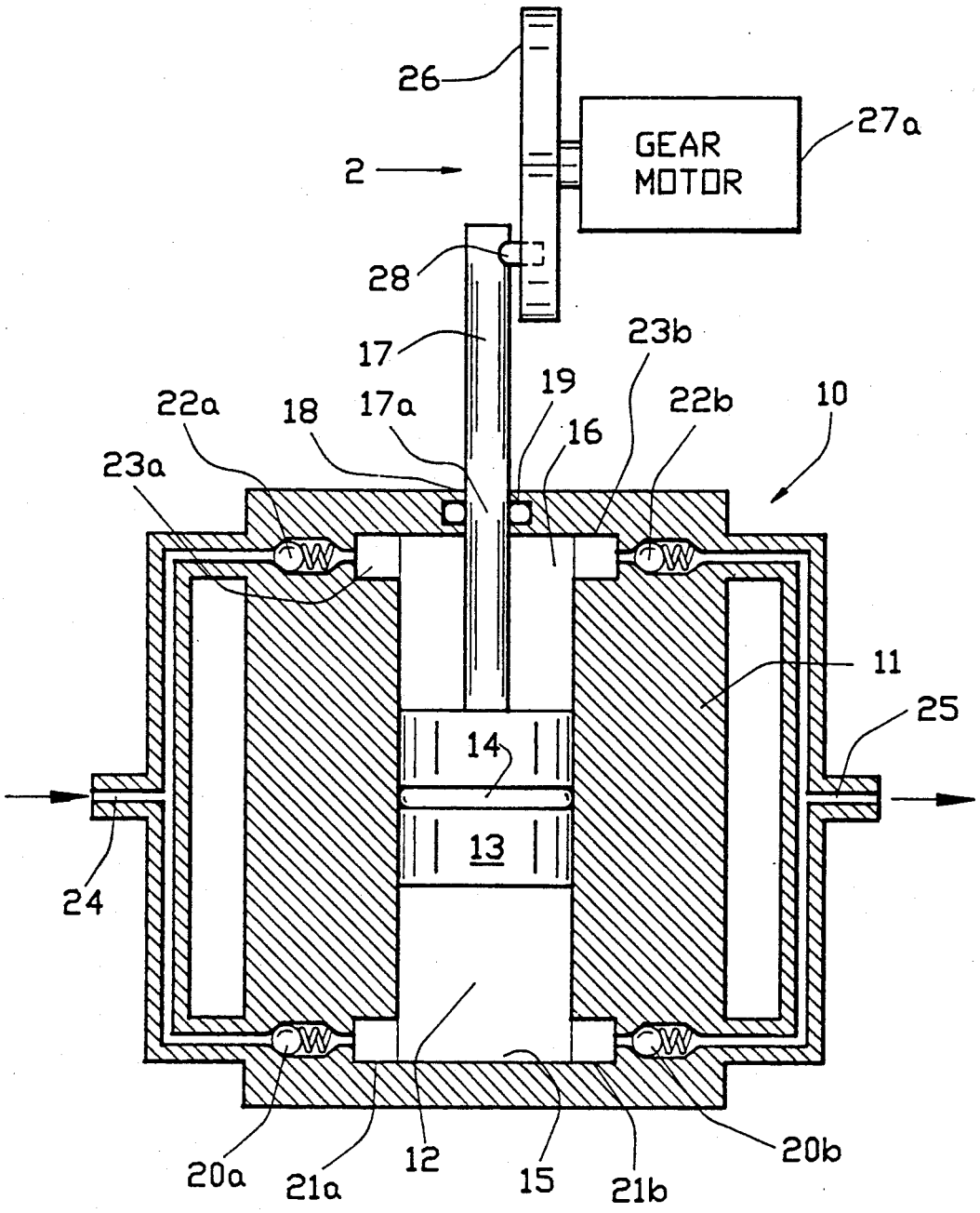
FIG. 1 is a simplified front view of one embodiment of the present invention showing the body of the pump in cross section.

Referring now to FIG. 1, therein is shown a simplified front view of a double acting pump 10 according to the present invention. The body 11 of the pump 10 is shown in cross section. The body 11 defines a piston bore 12 in which a piston 13 is positioned. The piston 13 is grooved to receive an O-ring seal 14. The piston bore 12 has a first end portion 15 and a second end portion 16. A shaft 17 is connected to the piston 13 and extends through an aperture 18 in the pump body 11. The aperture 18 is grooved to receive an O-ring seal 19. The shaft 17 has a cross sectional area **17*a* where it extends through the aperture 18. A first set of check valves 20*a* and 20*b* are in liquid communication with the first end portion 15 of the bore 12 via passageways 21*a* and 21*b*. A second set of check valves 22*a* and 22*b* are in liquid communication with the second end portion 16 of the bore 12 via passageways 23*a* and 23*b*. The check valves 20*a* and 22*a* are also in liquid communication with a split passageway 24 so that the pump 10 will aspirate a liquid to be pumped with each stroke of the piston 13. The check valves 22*b* and 20*b* are also in liquid communication with another split passageway 25 so that the pump 10 will deliver a liquid to be pumped with each stroke of the piston 13**.

Figure 2:
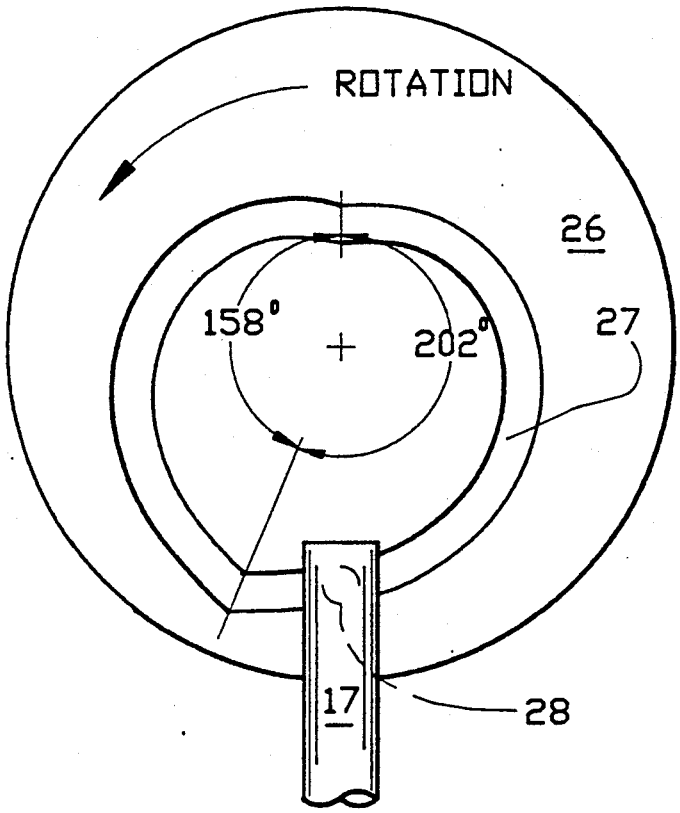
FIG. 2 is a side enlarged view of the cam, cam follower and shaft of the pump shown in FIG. 1.

The improvement of the present invention relates to the means for reciprocating the shaft 17. The means for reciprocating the shaft 17 is an asymmetrical uniform motion cam 26. The cam 26 is rotated by a selectable speed gear motor 27. Referring also to FIG. 2, the cam 26 has a uniform motion cam groove 27 cut into it. A cam follower 28 projects from the shaft 17 and rides in the groove 27. As the cam 26 is rotated in the direction shown, the cam follower 28 and shaft 17 are first forced downward for about 202 degrees of rotation of the cam 26 (the first phase of angular rotation of the cam 26) and then forced upward for about 158 degrees of rotation of the cam 26 (the second phase of angular rotation of the cam 26).

The cam 26 is an asymmetrical cam because the first phase of angular rotation is not equal to the second phase of angular rotation. A cam of the present invention can have two or more first phases and an equal number of corresponding second phases. However, it is preferred that the cam of the present invention have only a single first phase of angular rotation and a single second phase of angular rotation.

The cam of the present invention should ideally be a perfect asymmetric uniform motion cam that reciprocates the shaft at a perfectly constant velocity during a phase of the cam. However it should be understood that such a camming system is difficult, if not impossible, to achieve in practice, especially when the shaft direction is changed at the end of each phase of the cam. The use of a roller cam follower to reduce friction between the follower and the cam is especially problematic at the end of the first phase and the beginning of the second phase of the cam because of the relatively large radius of such a follower relative to the normal size of the cam (unless the cam is made unusually large relative to the diameter of the follower or unless the stroke of the cam is made relatively short). Thus, the term asymmetrical uniform motion rotary cam means a cam that reciprocates the shaft at a substantially constant velocity during substantially the entirety of the phases of the cam but not necessarily near the transitions between the phases of the cam. Preferably, the above described deviations from ideality during these transitions are designed to be as little as possible such as by the use of a cam like the cam 26. The cam of the present invention can, of course, be composed of a first cam and a second cam if the first cam accomplishes the first phase and the second cam accomplishes the second phase.

Since the piston 13 is connected to the shaft 17, the piston 13 is also reciprocated in the bore 12 when the cam 26 is rotated. The volume of a liquid pumped when the piston 13 is forced a given distance toward the first end portion 15 of the bore 12 is greater than the volume of a liquid pumped when the piston 13 is forced the same distance toward the second end portion 16 of the bore 12. This is true because the swept volume of the piston 13 is less when it is forced toward the second end portion 16 of the bore 12 in relation to the across sectional area 17*a* of the shaft and the cross sectional area of the piston 13. Therefore, in order that the pump 10 deliver substantially the same substantially constant flow rate of a liquid being pumped during the first phase of angular rotation of the cam 26 and the second phase of angular rotation of the cam 26, the first phase of angular rotation of the cam 26 must be greater in degrees of rotation than the second phase of angular rotation of the cam 26.

The first phase of angular rotation of the preferred cam 26 can be calculated in degrees according to the present invention with substantial accuracy, i.e., it is substantially equal to the quantity of three hundred and sixty times the cross sectional area of the piston 13 divided by the quantity of two times the cross sectional area of the piston 13 minus the cross sectional area of the shaft 17*a*. The second phase of angular rotation of the cam 26 can also be calculated in degrees according to the present invention with substantial accuracy, i.e., it is substantially equal to the quantity of three hundred and sixty minus the first phase of angular rotation in degrees of the cam 26. For example, when the piston 13 is one inch in diameter and the shaft 17 is 0.47 inches in diameter at the aperture 18, then the first phase of the cam 26 should be about 202 degrees and the second phase of the cam 26 , i.e., $(360)(0.7854)=282.7$; $[(2)(0.7854)]-0.1735=1.3973$; $282.7\div1.3973=$ about 202; and $360=202=158$. The above calculations are perfectly accurate only when the cam follower 28 has an infinitely small radius. However, the above calculations are substantially accurate even for a roller follower having a radius of six millimeters used with a peripheral working surface cam, discussed below, having a minor radius of seventeen millimeters and a major radius of twenty seven millimeters and, of course, a stroke of about ten millimeters. When a cam follower of infinite radius is used in the present invention, i.e., a flat faced cam follower, then a different calculation must be made according to the specific circumstances.

The use of a grooved cam like the cam 26 is not critical in the present invention. Any uniform motion rotary cam as defined above may be used as long as it has the above specified asymmetry, e.g., a cam having its camming surface on its periphery. The use of a grooved cam in the present invention, such as the cam 26, is beneficial because the load on the means used to rotate the cam, such as the gear motor 27, is more equal during a complete rotation of the cam than if the cam is overridden during one of its phases. However, it should be pointed out that it is possible in the present invention to have one peripheral type cam perform the first phase and another peripheral type cam perform the second phase so that the means used to rotate the cams is not overridden during any phase of this cam system. The grooved cam 26 also has the benefit of more ideal phase transition as discussed above. However, it is contemplated that an existing single action pump can be retrofitted to a pump of the present invention by, among other things, using a peripheral camming surface asymmetric constant motion cam and a roller cam follower. For example, an Altex Model 110 pump (available as catalog number F1010 from The Anspec Company, Ann Arbor Michigan) should be so-retrofitable to a pump of the present invention by: replacing the original pump head with a custom made double acting pump head assembly employing a pair of inlet and a pair of outlet check valves (Anspec catalog number H2075 and H2076), the piston having a diameter of eight millimeters, the shaft having a diameter of five millimeters and the stroke of the piston being ten millimeters; replacing the original pump cam with a custom made asymmetric uniform motion cam according to the present invention (first phase equal to 224 degrees of rotation, second phase equal to 136 degrees of rotation) having a minor radius of seventeen millimeters and a major radius of twenty seven millimeters; a roller cam follower having a radius of six millimeters; and deactivating the original pump motor speed-up/fast-refill feature so that the pump motor is controlled to run at its selected substantially constant speed by the remaining original tachometer control system (however, it would also be desirable to only modify the speed-up/fast-refill feature of this pump to increase the motor speed for several degrees of rotation of the cam when the tip of the cam passes the follower at the transition between the first phase and the second phase of the cam so that more ideal pumping can be obtained during this transition).

One primary application of the present invention is pumping the mobile phase in a liquid chromatography system. However, this is not the only application of the present invention. A pump according to the present invention should be beneficial in any application where substantially pulseless and constant flow is needed such as in many chemical processing, health care, biomedical and food processing applications.

The present invention is also an improved method for reciprocating the piston of a double acting pump in its first direction and then in its second direction. The improvement comprises the steps of: (1) forcing the piston in the first direction at a substantially constant first velocity for substantially the entirety of the piston travel in the first direction; and (2) then forcing the piston in the second direction at a substantially constant second velocity for substantially the entirety of the piston travel in the second direction, the ratio of the first velocity to the second velocity being substantially the same as the ratio of the swept volume of the piston in the second direction to the swept volume of the piston in the first direction. This method is applicable to any double acting pump including such pumps that have one piston shaft extending through the body of the pump, two piston shafts extending from the body of the pump or no piston shaft at all, e.g., where the piston is directly contacted by a cam.

The present invention is also an improved double acting pump, the piston of which is driven directly or indirectly by a speed controlled motor in a first direction and then in a second direction, the pump not including an asymmetric constant motion rotary cam but other means for reciprocating the piston such as a constant acceleration cam, a hybrid cam or a crank shaft. Such pumps inherently pump at varying rates during the pump cycle. The improvement of this aspect of the present invention is a means for controlling the speed of the motor according to a mathematical function that results in the piston being forced in the first direction at a substantially constant first velocity for substantially the entirety of the piston travel in the first direction; and then forced in the second direction at a substantially constant second velocity for substantially the entirety of the piston travel in the second direction, the ratio of the first velocity to the second velocity being substantially the same as the ratio of the swept volume of the piston in the second direction to the swept volume of the piston in the first direction.

An example of this approach would be to modify the above mentioned Altex Model 110 pump by: replacing the original pump head with a custom made double acting pump head assembly employing a pair of inlet and a pair of outlet check valves, the piston having a diameter of eight millimeters, the shaft having a diameter of five millimeters, and the piston stroke being ten millimeters; replacing the original pump cam with an eccentric cam having a minor radius of seventeen millimeters and a major radius of twenty seven millimeters; a roller cam follower having a radius of six millimeters; deactivating the original pump motor speedup/fast-refill feature; and replacing the original tachometer system with an appropriately programmed microprocessor or digital computer controlled system to vary the pump motor speed in a sinusoidal manner so that the method of the present invention is followed. In this example it would be beneficial to use two or more roller cam followers encompassing the cam, the followers connected to a yoke, the yoke connected to the piston shaft, so that the motor would be loaded substantially equally when the piston is being forced in the first direction as when the piston is being forced in the second direction.

What is claimed is:

1. An improved double acting pump generally comprising a pump body, a piston bore, a piston, a first set of check valves, a second set of check valves, a shaft and a means for reciprocating the shaft, the piston having a cross sectional area, the body defining the piston bore, the piston bore having a first end portion and a second end portion, the piston positioned in the piston bore between the first end portion of the piston bore and the second end portion of the piston bore, the shaft connected to the piston so that the piston can be reciprocated to stroke in a first direction toward the first end portion of the piston bore and then to stroke in the opposite direction toward the second end portion of the piston bore, the shaft extending through an aperture in the pump body, the aperture in the pump body being located adjacent the second end portion of the piston bore, the shaft having a cross sectional area where the shaft extends through the aperture in the pump body, the first set of check valves being in liquid communication with the first end portion of the piston bore, the second set of check valves being in liquid communication with the second end portion of the piston bore so that on each stroke of the piston the pump both aspirates and delivers a liquid to be pumped, wherein the improvement comprises: that the means for reciprocating the shaft comprises an asymmetrical uniform motion rotary cam having a first phase of angular rotation during which the piston is driven toward the first end portion of the piston bore and a second phase of angular rotation during which the piston is driven toward the second end portion of the piston bore, the first phase of angular rotation of the cam being greater in degrees of rotation than the second phase of angular rotation of the cam so that the pump delivers substantially the same substantially constant flow rate of a liquid being pumped during both the first phase of angular rotation of the cam and the second phase of angular rotation of the cam.

2. The improved pump of claim 1, wherein the asymmetrical uniform motion cam has substantially only a single first phase of angular rotation and a single second phase of angular rotation.

3. The improved pump of claim 2, wherein the first phase of angular rotation in degrees is substantially equal to the quantity of three hundred and sixty times the cross sectional area of the piston divided by the quantity of two times the cross sectional area of the piston minus the cross sectional area of the shaft and the second phase of angular rotation in degrees is substantially equal to the quantity of three hundred and sixty minus the first phase of angular rotation in degrees.

* * * * *